US008176961B2

(12) United States Patent
Pelekanos

(10) Patent No.: US 8,176,961 B2
(45) Date of Patent: May 15, 2012

(54) SLIDING SCREEN ASSEMBLY AND COMPONENTS

(75) Inventor: Stylianos Pelekanos, New South Wales (AU)

(73) Assignee: RMD Press Co Pty Limited, Victoria (AU)

( * ) Notice: Subject to any disclaimer, the term of this patent is extended or adjusted under 35 U.S.C. 154(b) by 58 days.

(21) Appl. No.: 12/817,897

(22) Filed: Jun. 17, 2010

(65) Prior Publication Data

US 2010/0319861 A1 Dec. 23, 2010

(30) Foreign Application Priority Data

Jun. 18, 2009 (AU) ..... 2009902834

(51) Int. Cl.
*E06B 3/94* (2006.01)

(52) U.S. Cl. ..... 160/84.06; 160/172 R; 160/277

(58) Field of Classification Search ..... 160/84.06, 160/172 R, 279, 277
See application file for complete search history.

(56) References Cited

U.S. PATENT DOCUMENTS

| | | | | |
|---|---|---|---|---|
| 5,377,737 | A * | 1/1995 | Moriya et al. | 160/84.06 |
| 7,673,666 | B2 * | 3/2010 | Fan | 160/84.04 |
| 7,730,926 | B2 * | 6/2010 | Moriya et al. | 160/84.06 |
| 7,891,398 | B2 * | 2/2011 | Chino et al. | 160/84.06 |
| 2009/0199977 | A1 * | 8/2009 | Bohlen | 160/84.06 |
| 2010/0319861 | A1 * | 12/2010 | Pelekanos | 160/378 |

* cited by examiner

*Primary Examiner* — Blair M. Johnson
(74) *Attorney, Agent, or Firm* — Kilpatrick Townsend & Stockton LLP

(57) ABSTRACT

A sliding screen assembly (1) with a screen (3), a pull bar (4) for movement between an open and a closed position, a series of guide wires (9,10) which pass through the screen (3) and pull bar (4) to be attached to an adjacent frame (2) of the assembly (1), the assembly (1) including a cassette (30) mounted to the frame (2) for fastening ends of the guide wires (9,10), the cassette (3) having an anchor block (32) to secure the cassette (30) in an associated upper track (7) and/or lower track (8) of the assembly (1) and a fastening mechanism (43) to adjustably secure the wires (9,10) to the cassette (30).

6 Claims, 13 Drawing Sheets

SLIDING SCREEN ASSEMBLY AND COMPONENTS

FIELD OF THE INVENTION

The present invention relates to a sliding screen assembly.

BACKGROUND OF THE INVENTION

A known sliding screen assembly includes a frame which is fitted to an exterior of an existing window. The frame houses a mesh screen which is attached to a pull bar arranged to move between open and closed positions. In the open position, the screen is concertinaed against one side of the frame to provide free access through an opening defined by the frame. In the closed position, the screen is fully extended across the opening.

The pull bar and screen travel on a series of guide wires which provide support and degree of rigidity to the screen and pull bar. The guide wires are fixed to the concertinaed screen side of the frame, follow spaced apart parallel paths through the screen, are diverted through holes in the pull bar to opposite ends of the pull bar and then tied to the opposite side of the frame.

The guide wires run adjacent the frame, between the pull bar and associated tie points, so as not to obstruct the opening when the pull bar is in the open position.

Frictional loads generated by the wires passing through the pull bar, as it is moved between the open and closed positions, render this assembly design suitable for small scale use only such as, for example, use in association with a conventional house window. The method of tying off the guide wires can also be problematic as the tie points need to be close to the side of the frame in order to provide free passage of the pull bar into the closed position, and manual tying can be difficult in the limited space available. Also, manual tying of the wires may lead to inappropriate tensioning of some of the wires, which can restrict smooth travel of the pull bar or cause the pull bar to be skew.

OBJECT OF THE INVENTION

The present invention seeks to address one of more of the above issues.

SUMMARY OF THE INVENTION

In accordance with the invention, there is provided a sliding screen assembly with a screen, a pull bar for movement between an open and a closed position, a series of guide wires which pass through the screen and pull bar to be attached to an adjacent frame of the assembly, the assembly including a cassette mounted to the frame for fastening ends of the guide wires, the cassette having an anchor block to secure the cassette in a track of the assembly and a fastening mechanism to adjustably secure the wires to the cassette.

Preferably, the cassette includes an elongate body with the anchor block located towards one end and the fastening mechanism being adjustably positioned toward the other end.

Preferably, the cassette is mounted in a track of the frame and the anchor block includes a head section, which is captured under flanges defining the track opening.

Preferably, the fastening mechanism includes a clamp associated with an associated one of the wires, each clamp being arranged to slide along the cassette to provide for tension adjustment.

Preferably, the anchor block includes a cross piece which is located adjacent the frame, the guide wires between the fastening mechanism and bar passing over the cross piece.

In another aspect, there is provided a cassette for use in a sliding screen assembly, as described above.

In another aspect, there is provided a roller device for diverting a guide wire through a pull bar of a sliding screen assembly, as described above, the roller assembly including a housing for carrying a roller wheel, the housing having a boss for locating the device in a slot of the bar, the boss having an enlarged section to lock the device in place and a passage to lead the guide wire through the boss and onto the roller wheel.

BRIEF DESCRIPTION OF THE DRAWINGS

The invention is described, by way of non-limiting example only, with reference to the drawings, in which.

DETAILED DESCRIPTION OF THE INVENTION

Figure 1:
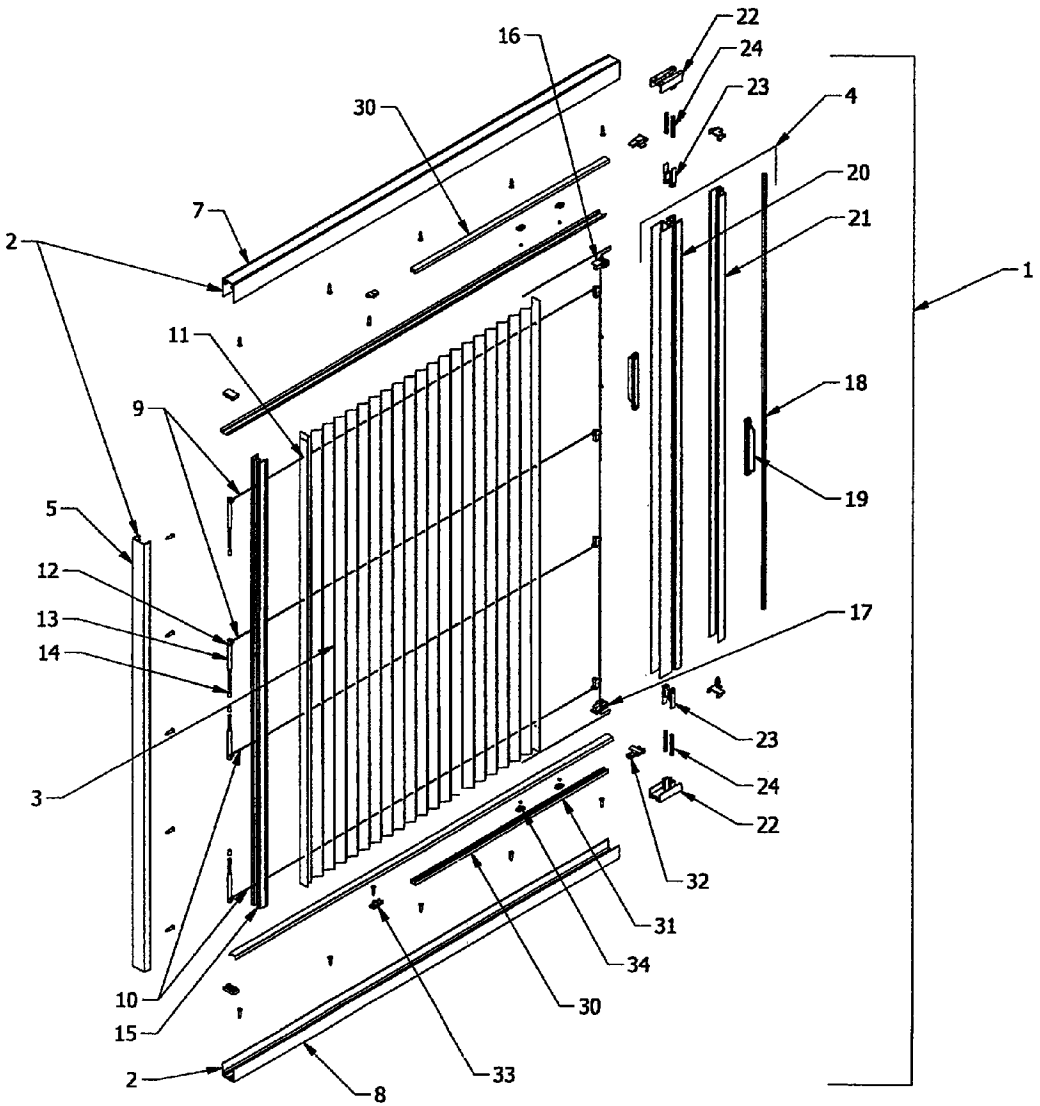
FIG. 1 is an exploded perspective view of a sliding screen assembly.

A screen assembly (1) is shown in FIG. 1 as including a frame (2), a concertinaed screen (3) and a pull bar (4). The frame (2) includes a first generally vertical side jamb (5) which extends between an generally horizontal upper track (7) and generally horizontal lower channel or track (8). The frame also includes a second generally vertical side jamb (6) (shown in part in FIG. 3*e*) which extends between opposing ends of the upper track (7) and the lower track (8) relative to the first side jamb (5).

A series of two upper guide wires (9) and two lower guide wires (10) are arranged to pass through holes (11) formed in the screen (3). The wires (9), (10) are spring mounted at one end, adjacent the jamb (5) using an associated wire guide (12), spring guide (13) and stop (14), which are in turn fixed relative to a jamb extrusion (15). The wires (9), (10) pass though the pull bar (4) and are guided to diverter rollers (16), (17).

The pull bar (4) is formed of a seal (18), a handle (19), a bar extrusion (20) and a cover (21). The cover (21) having a channel section which allows the wires (9), (10) to be guided between the rollers (16), (17) internally of the bar (4). It may be appreciated, when the sliding screen assembly is in a closed position seal (18) acts against the opposing jamb (not shown).

The bar (4) also has a friction block (22) mounted at either end, via a mounting block (23) and compression springs (24). The friction blocks (22) act against the respective upper track (7) and lower track (8), to allow the pull bar (4) to be frictionally held in position, if required. The rollers (16), (17) are configured to fit with the friction blocks (22) so as to prevent the blocks (22) being disengaged from the pull bar (4).

In the arrangement shown, the bottom pair of wires (10) are directed upwardly though the pull bar (4), and the upper pair of wires (9) is directed downwardly, so that each pair of wires passes to a respective diverter roller (16), (17). The diverted wires are fixed to an associated cassette (30).

Each cassette (30) includes an elongate body (31) with an anchor block (32) and fastener (33) to mount the cassette in the channel section provided by the respective upper track (7) and the lower track (8). An adjustable fastening mechanism (34) is carried by each cassette for securing the wires in place.

Figure 2A:
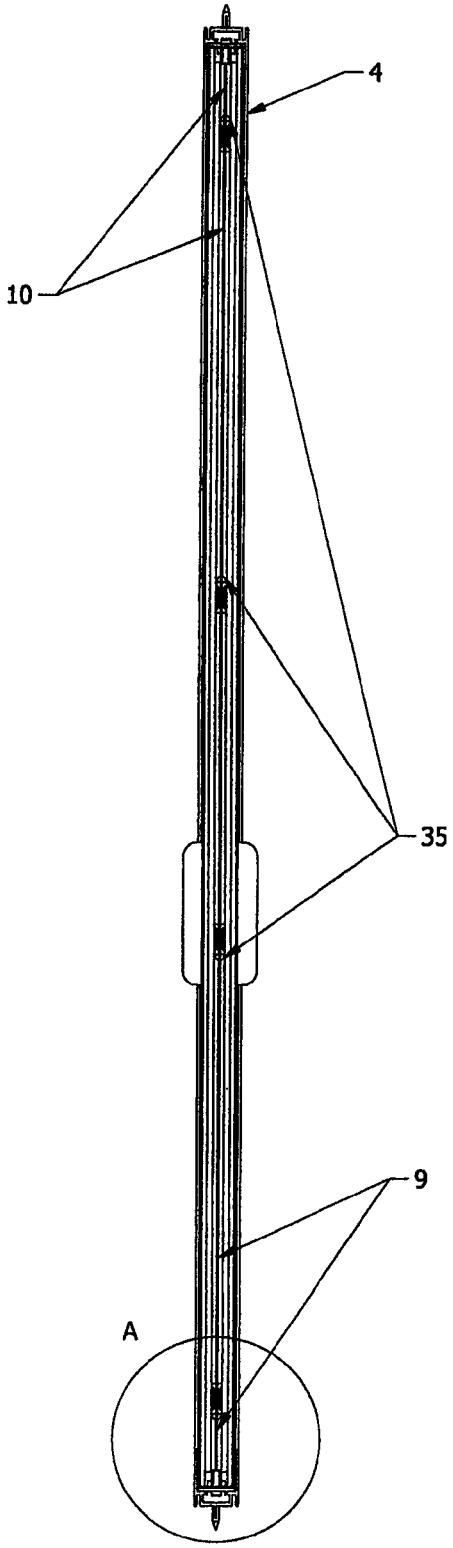
FIG. 2*a* illustrates a view of a pull bar.

Referring now to FIG. 2*a*, the pull bar (4) is shown as including slots (35), in positions corresponding to the locations at which the guide wires (9), (10) pass through the pull bar (4).

Figure 2B:
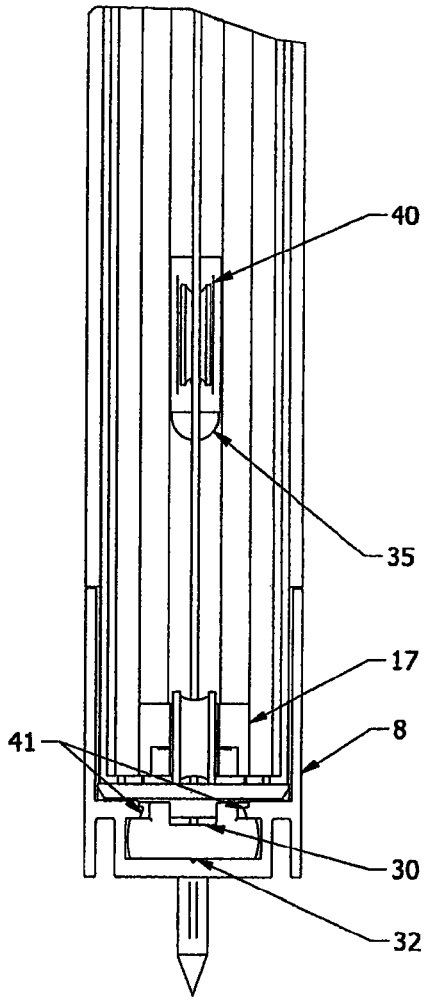
FIG. 2*b* illustrates a detail view A of an end of the pull bar illustrated in FIG. 2*a*.

FIG. 2*b* shows a roller device (40) positioned to guide the wire through the slot (35), between the slot (35) and the diverter roller (17) and subsequently to the cassette (30). The anchor block (32) of the cassette (30) is clearly illustrated as being captured under flanges (41) of the channel shaped lower track (8), to lock the cassette in the lower track (8) and fastener (33) further secures the cassette at the appropriate location in the lower track (8).

The cassette (30) is loaded into the track (8), as shown in more detail in FIG. 3.

Figures 3A, 3B:
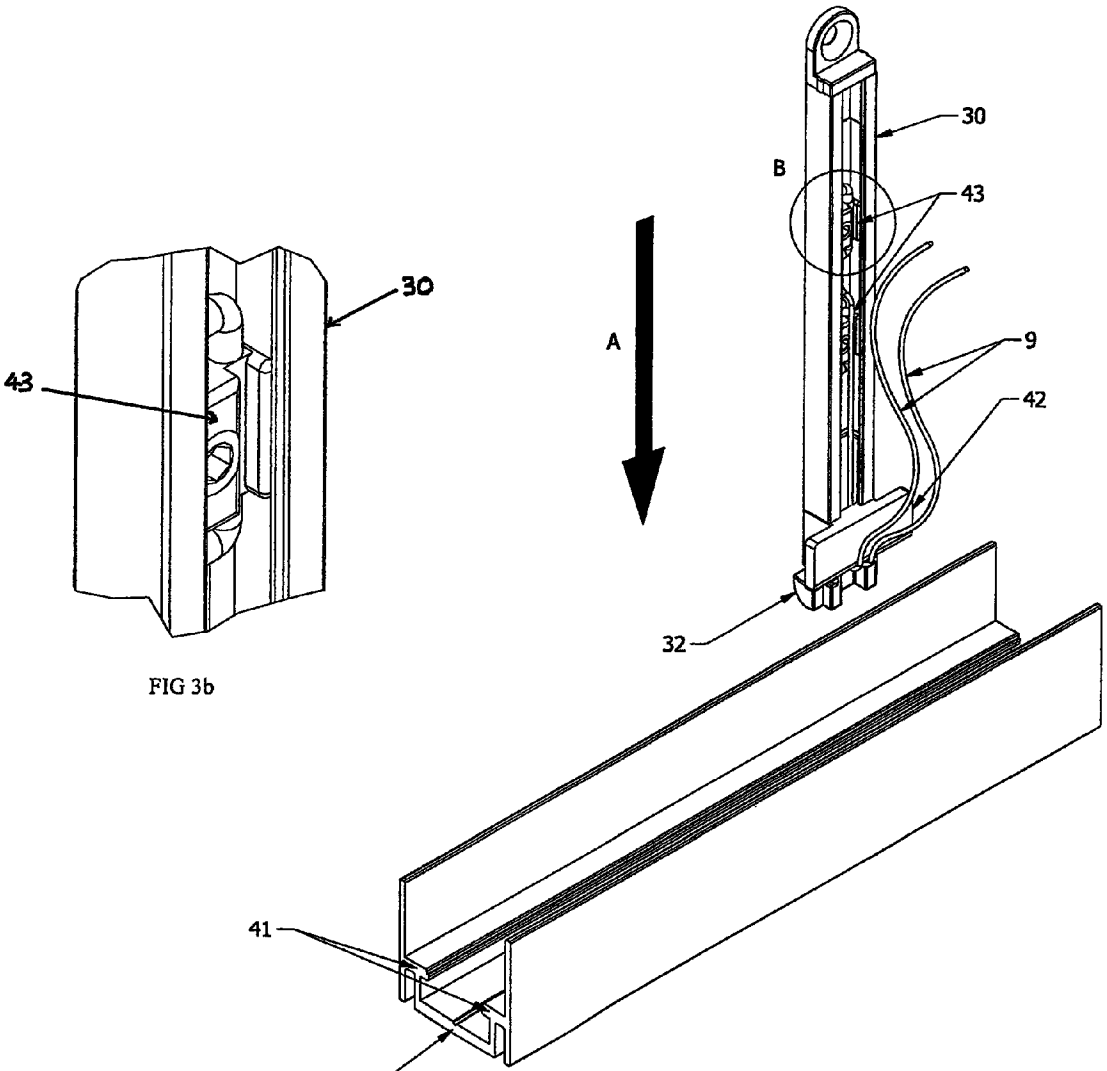
FIG. 3*a* is perspective view illustrating the cassette being fitted in a track of the assembly.
FIG. 3*b* is a detail view B of a clamp received within the cassette illustrated in FIG. 3*a*.

In FIG. 3*a*, the cassette (30) is oriented at right angles to the lower track (8) so that the anchor block (32) is allowed to be inserted in a direction indicated by arrow "A", between the flanges (41) which define the entrance to the lower track (8). Prior to insertion, the wires (9), as a pair, are passed over a cross piece (42) of the anchor block (32) and attached to a fastening mechanism, in the form of clamps (43) which can be positioned at variable locations along the length of the cassette (30). FIG. 3*b* one of the clamps 43 received within the section provided by the elongate body (31) of the cassette (30).

Figure 3C:
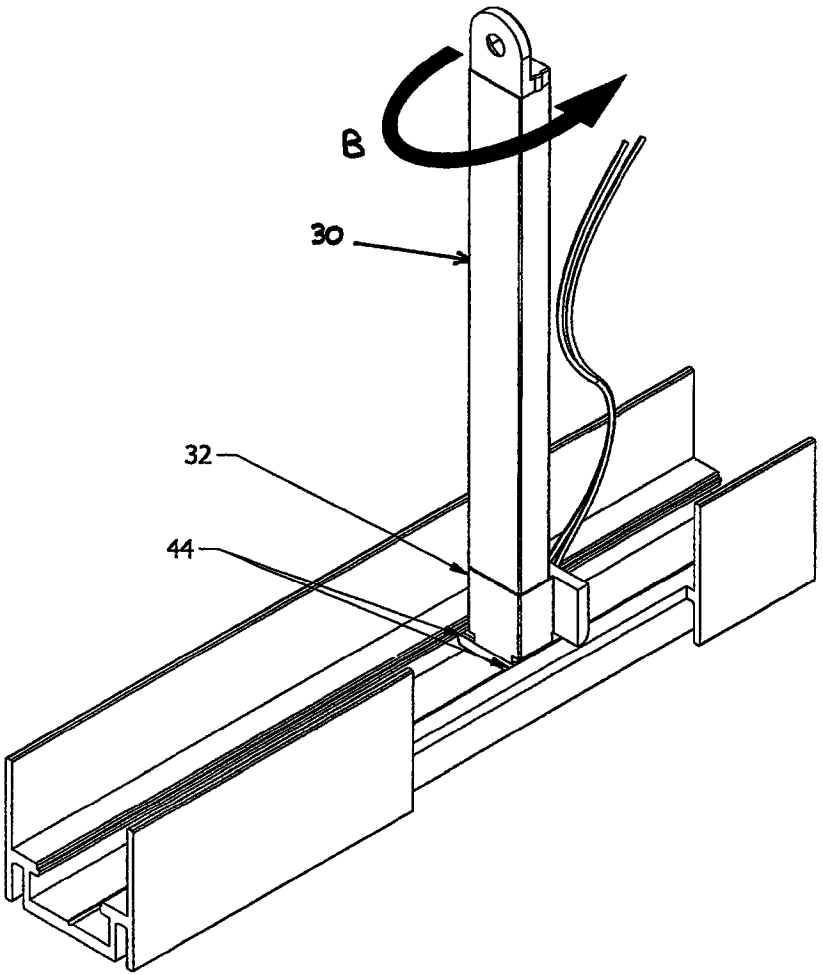
FIG. 3*c* is another perspective view illustrating the cassette being fitted in the track of the assembly.
Figure 3D:
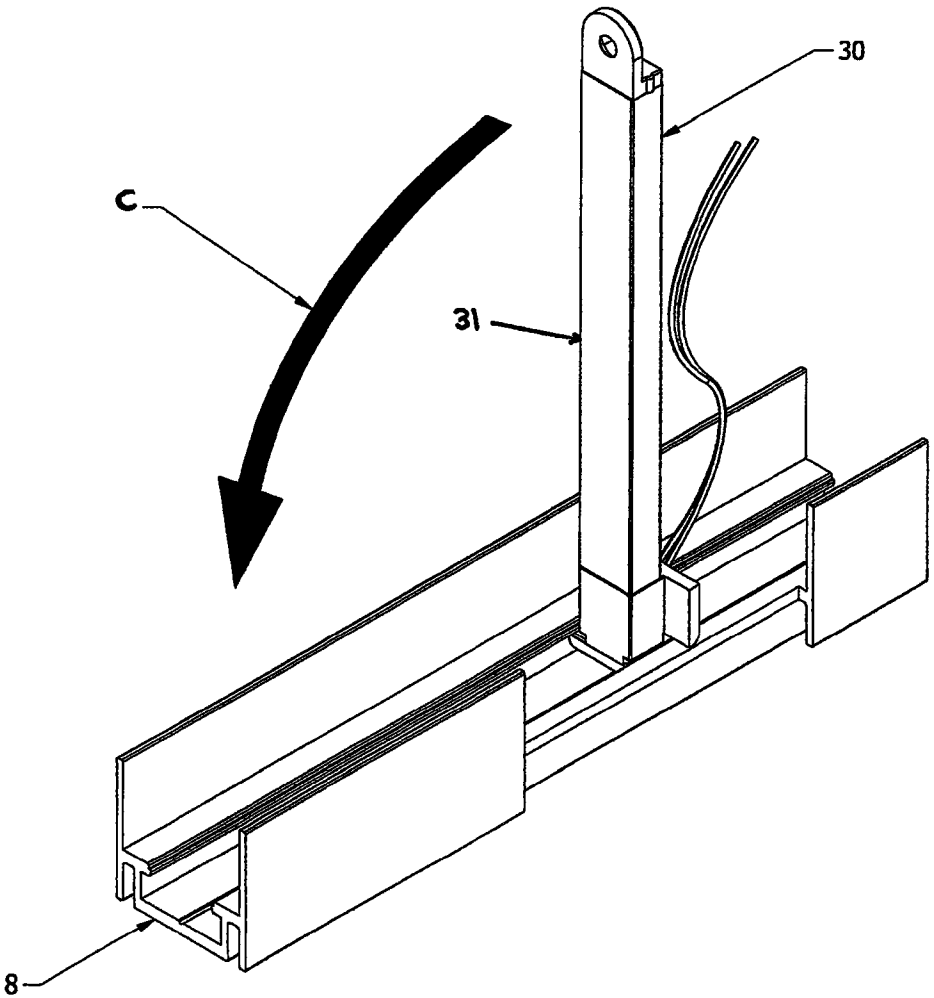
FIG. 3*d* is another perspective view illustrating the cassette being fitted in the track of the assembly.

In FIG. 3*c*, the cassette (30) is illustrated as being rotated 90 degrees by arrow "B" so that shoulders (44) of the anchor block (32) are rotated under the flanges (41), after which the elongate body (31) is pivoted down into the lower track (8), in a direction indicated by arrow "C", as shown in FIG. 3*d*.

Figure 3E:
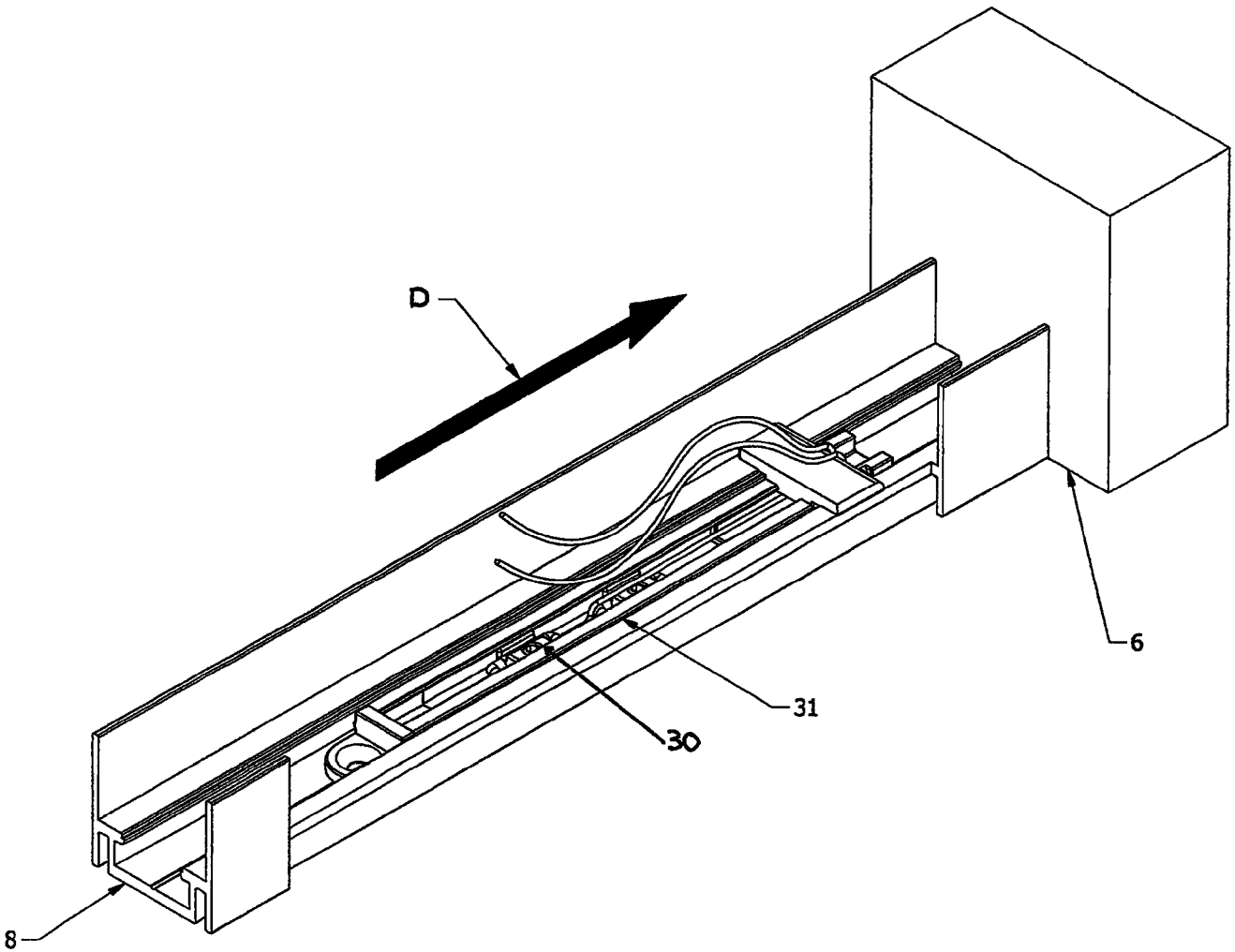
FIG. 3*e* is another perspective view illustrating the cassette being fitted in the track of the assembly.

Once the cassette (30) is located in the lower track (8), the body (31) is shunted along the lower track (8), in a direction indicated by arrow "D", shown in FIG. 3*e*, until in abutment with the opposing jamb (6).

Figure 3F:
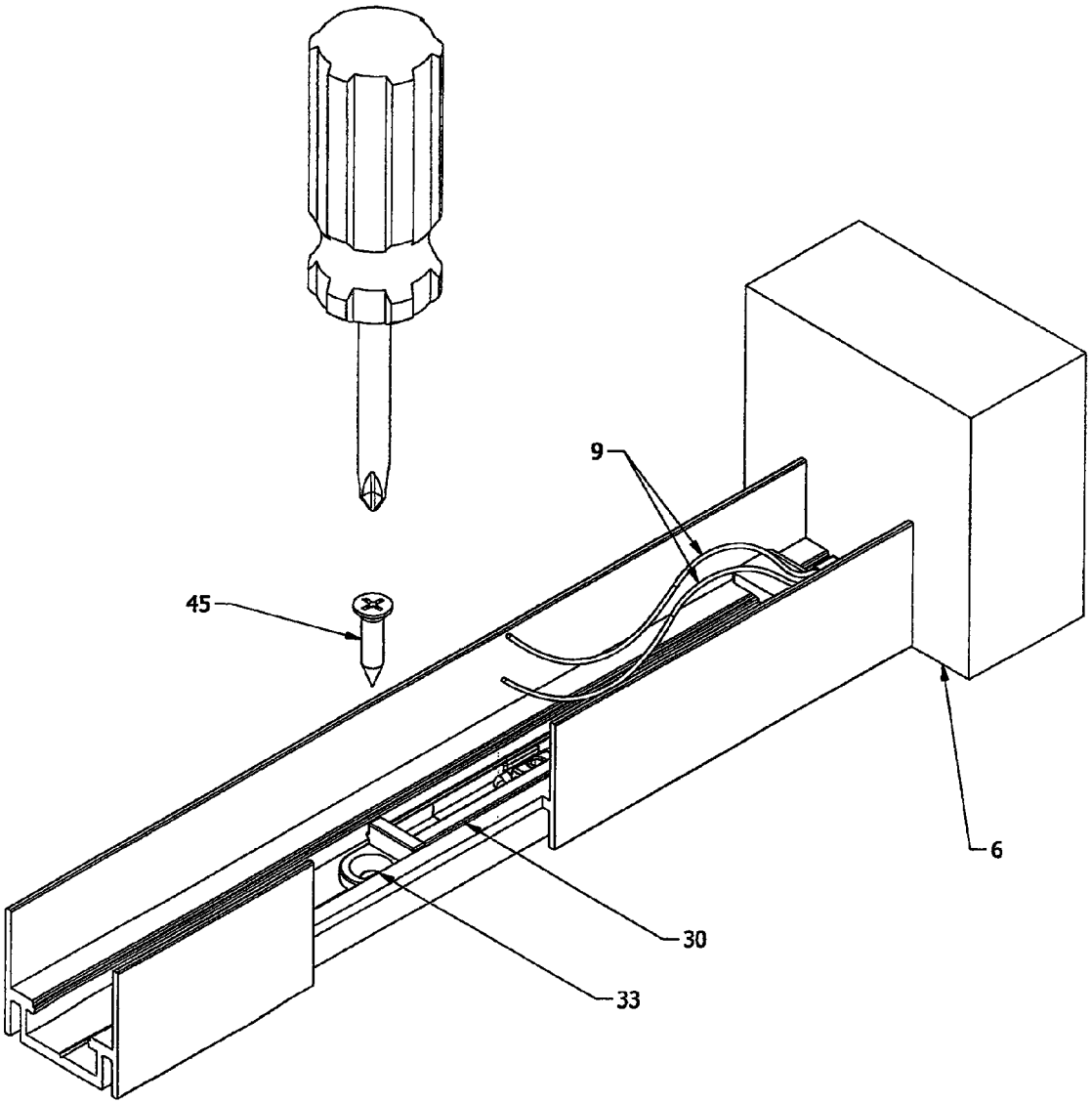
FIG. 3*f* illustrates the cassette being fixed in place.

After the cassette (30) has been appropriately located, as shown in FIG. 3*f*, the fastener (33) may be engaged by a screw (45) or the like to securely locate the cassette (30) in place.

Figure 3G:
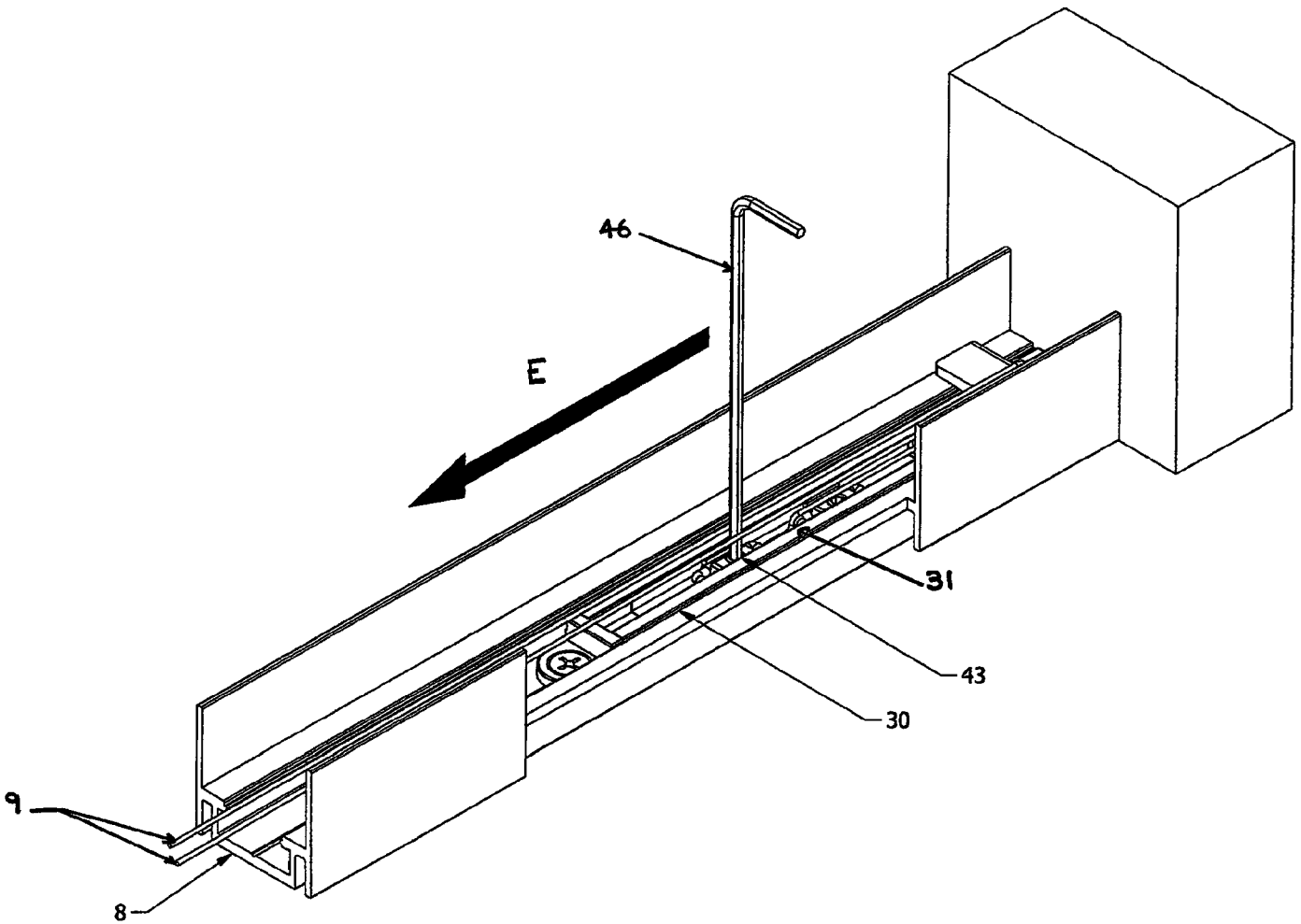
FIG. 3*g* illustrates tensioning of guide wires.

With reference to FIG. 3*g*, in order to tension the wires (9), the clamps (43) may be positioned, as required, at appropriate locations along the cassette (30) and fixed in place by a key (46), which not only fastens the clamps (43) in the body (31) but also fixes the wires (9) in the clamps (43). For example, to tension the wires the clamps (43) may be moved in a direction indicated by arrow "E". The clamps (43) may also be moved in a direction opposite to arrow "E".

As may be appreciated, the cassette provides a convenient mechanism for not only anchoring the wires relative to the frame (2) of the assembly (1) but also for adjusting the tension in the individual wires (9), as required. Since the guide wires pass over the cross piece before being fixed in the fastening mechanism, the pull bar is free to slide to the very end of the lower track (8), without obstruction, whilst ample room is provided to adjust and manipulate the clamps, without being restricted by the prior art space constraints associated with tying off directly on the jamb itself. Also, the fastening mechanism clamps (43) are rebated in the lower track (8) and can be readily covered with a snap-fit plastic strip which hides the entire cassette from view and provides a better aesthetic appearance.

The cassette (30) for the upper track (7) has an identical configuration and provides the same adjustment advantages. Accordingly, the above described process also applied to operative coupling the cassette (30) with the upper track (7).

Figure 4C:
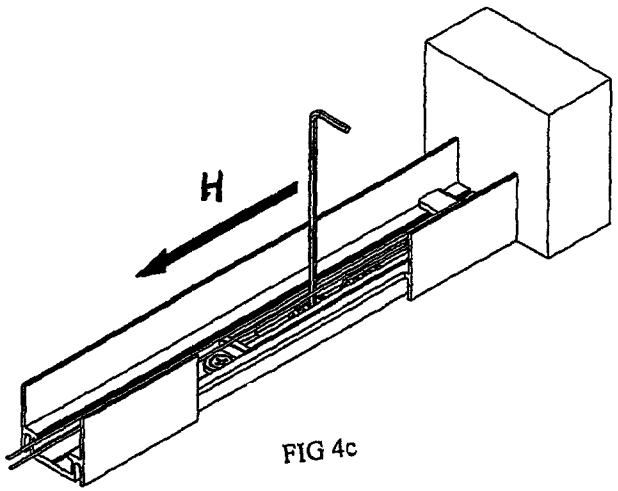
FIG. 4*c* illustrates tensioning of the guide wires.
Figure 4A:
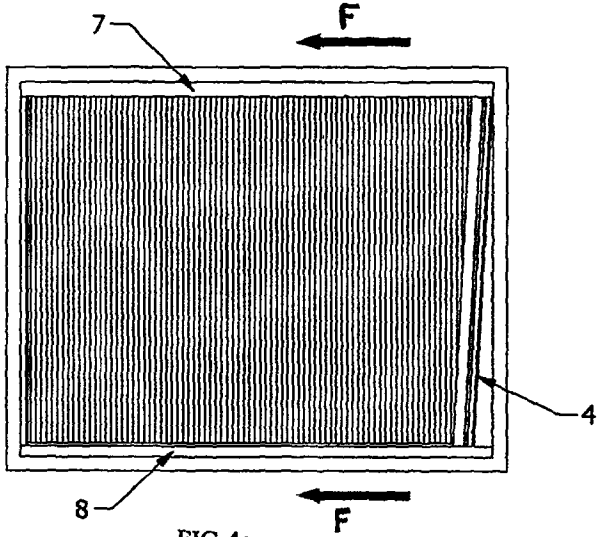
FIGS. 4*a* and 4*b* illustrate skewed pull bar positions.

Turning now to FIG. 4*a*, an example is provided of the pull bar (4) being incorrectly tensioned so that the bar (4) is skewed to the side. In order to rectify this problem, the lower cassette (30) may be accessed and the clamps (43) moved accordingly, to further tension the wires (9) terminated in the lower track (8). Alternatively, the tension of the wires (10) terminated in the track (7) may be adjusted, as required. Arrows "F" indicate the direction of movement of the respective clamps (43) to tension the respective wires to remove a gap between the jamb (6) and pull bar (4) so as to straighten the orientation of the pull bar (4).

Figure 4B:
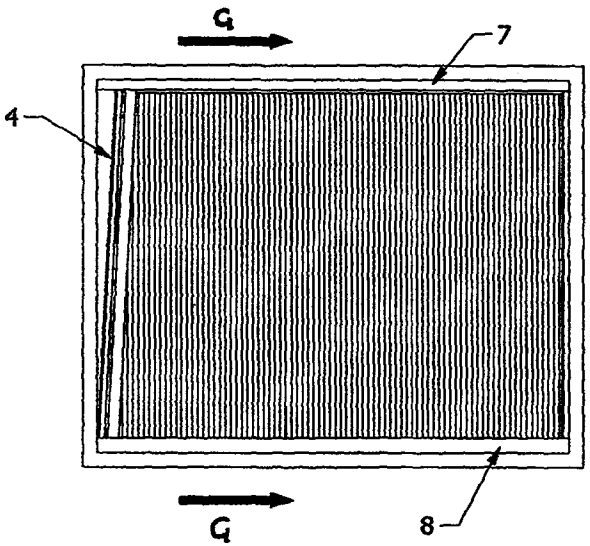

The pull bar (4) is shown in FIG. 4*b* as being skewed to the opposite side and the reverse adjustment process may be undertaken to provide relevant tension to the wires (9), (10) as required. Arrows "G" indicates the direction of movement of the respective clamps (43) to tension the respective wires to remove a gap between the jamb (6) and pull bar (4) so as to straighten the orientation of the pull bar (4).

The tensioning of the wires (9), (10) can also be readily adjusted to cope for situations where the jamb (6) is itself out of alignment and the bar (4) needs to be angled to match the tilt of the jamb in order for the seal (18) to fit properly against the jamb (6). To adjust the tensioning of the wires the clamps (43) may be releasably actuated and moved in a direction as indicted by arrow "H" on FIG. 4*c*. The clamps (43) may also be moved in a direction opposite to arrow "H", as required.

Figure 5:
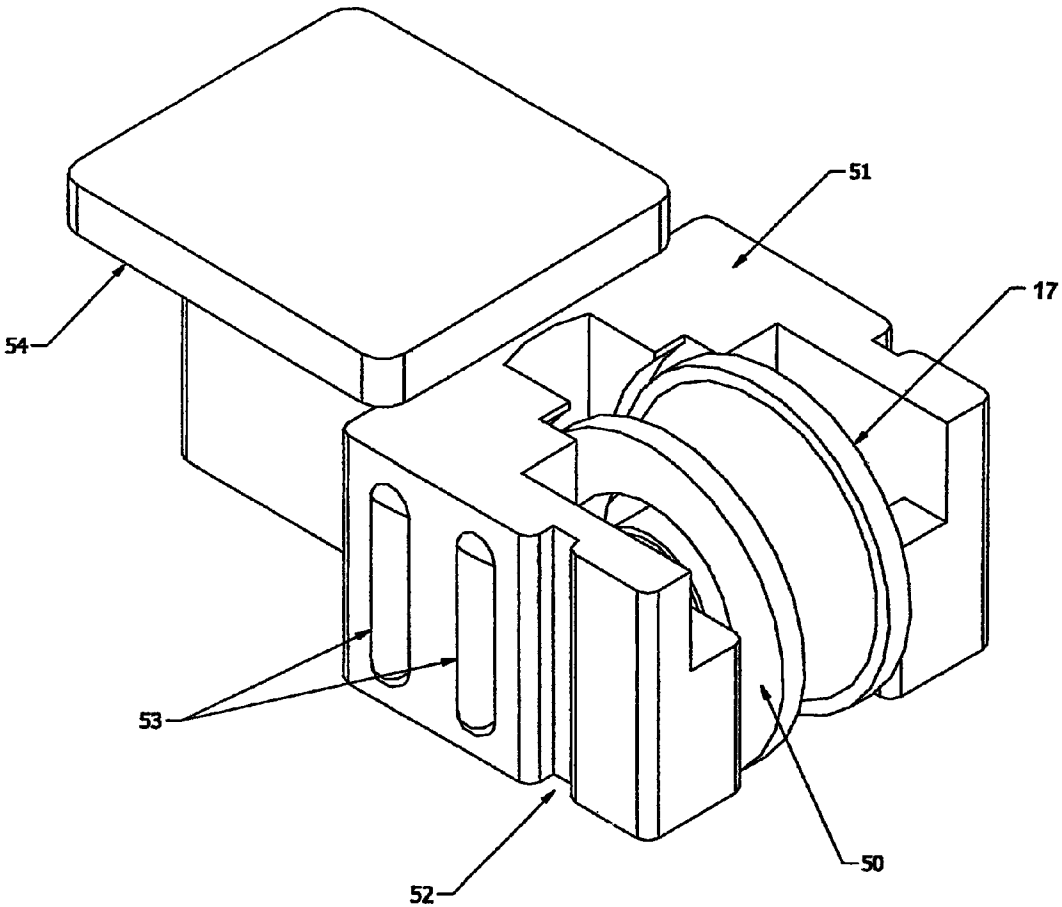
FIG. 5 is a perspective view of a diverting roller, as illustrated in FIG. 2.
Figure 6:
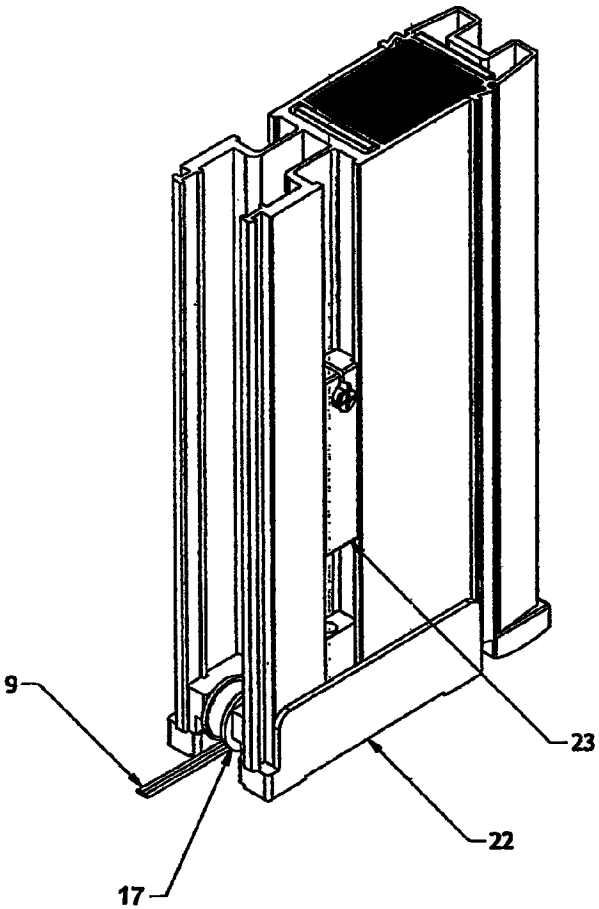
FIG. 6 is a perspective view of a lower end of the pull bar and roller.

Referring now to FIGS. 5 and 6, the diverter roller (17) is shown in more detail, as including a wheel (50), which is housed in a mount (51), with side grooves (52) for sliding engagement within the pull bar extrusion (20). Ribs (53) serve to secure the mount (51) in the extrusion (20) in snap-fit relation. The mount (51) has a detent surface (54) to inter-fit with one of the friction blocks (22), as described above, to lock the block (22) into the extrusion (20).

Figure 7:
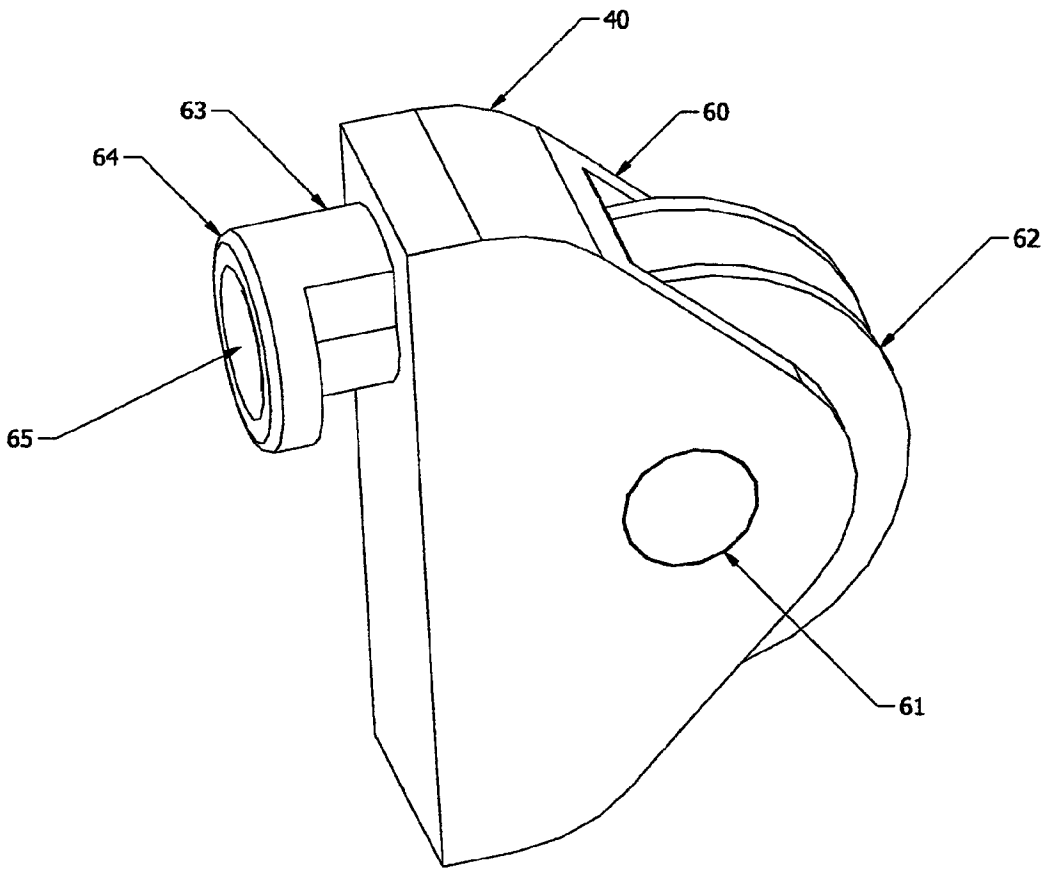
FIG. 7 is a perspective view of a roller device, as illustrated in FIG. 2.
Figure 8:
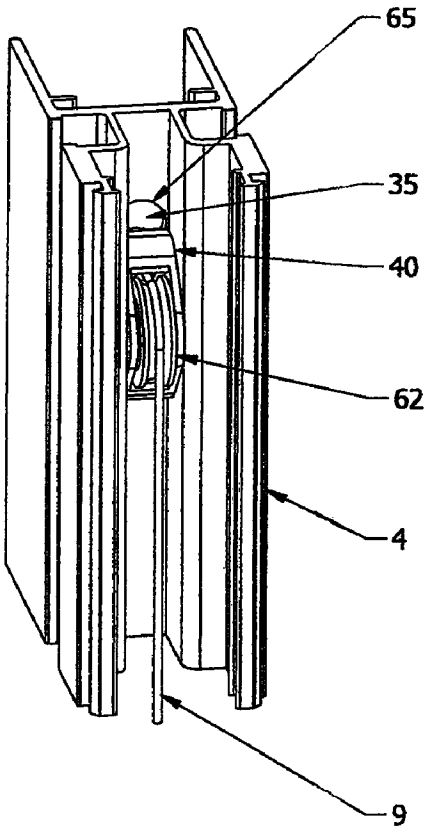
FIG. 8 is a front view of the device mounted to the pull bar.

With reference now to FIGS. 7 and 8, one of the roller devices (40) is illustrated as including a housing (60) with a generally triangular profile. The housing (60) supports an axle (61) of a wheel (62) which is provided with internal bearings. The housing includes an integrally moulded boss (63), which has an enlarged annular section (64) and a through passage (65), which leads onto a periphery of the wheel.

The roller device (40) is, in use, positioned in one of the various slots (35), which are preferably formed as key-hole shaped slots. The device (40) is fitted to the slot (35) by introducing the boss (63) through a wider part of the slot (35) and then sliding the boss into a smaller part of the slot (35) so that the enlarged section (64) locks the device (40) in place. In that position, the device (40) is adapted to receive one of the wires through the passage (65), onto the wheel (62) for redirection to one of the diverter rollers.

As such, it may be appreciated, the roller devices (40) provide an alternative arrangement for reduced frictional movement of the wires through the pull bar (4), as compared to the prior art system of simply diverting the wires through holes provided in the pull bar. Accordingly, the devices allow for smoother and reduced friction movement of the pull bar (4) during opening and closing of the screen (3). Additionally, the reduction in friction serves to reduce the loading and wear on the components included in the screen assembly (1), for example wires (9) and (10). This allows the screen assembly (1) to sustain a greater number of open and closing cycles before failure in comparison to the abovementioned prior art system.

The invention has been described by way of non-limiting example only and many modifications and variations may be made without departing from the spirit and scope of the invention described.

LIST OF PARTS

1. Screen Assembly
2. Frame
3. Concertinaed Screen
4. Pull Bar
5. First Jamb
6. Second Jamb
7. Upper Track
8. Lower Track
9. Upper Wire
10. Lower Wire
11. Holes
12. Wire Guide
13. Spring Guide
14. Stop
15. Jamb Extrusion
16. Diverter Roller
17. Diverter Roller
18. Seal
19. Handle
20. Bar Extrusion
21. Cover
22. Friction Block
23. Mounting Block
24. Compression Springs
30. Cassette
31. Elongate Body
32. Anchor Block
33. Fastener
34. Adjustable Fastening Mechanism
35. Slots
40. Roller Device
41. Flange
42. Cross piece
43. Clamps
44. Shoulders
45. Screw
46. Key
50. Wheel
51. Mount
52. Side Groves
53. Ribs
54. Detent Surface
60. Housing
61. Axle
62. Wheel
63. Boss
64. Annular Section
65. Passage The claims defining the invention are as follows:

1. A sliding screen assembly with a screen, a pull bar for movement between an open and a closed position, a series of guide wires which pass through the screen and pull bar to be attached to an adjacent frame of the assembly, the assembly including a cassette mounted to the frame for fastening ends of the guide wires, the cassette having an anchor block to secure the cassette in a track of the assembly and a fastening mechanism to adjustably secure the wires to the cassette, wherein the cassette includes an elongate body with the anchor block located towards one end and the fastening mechanism being adjustably positioned toward the other end.

2. The sliding screen assembly of claim 1, wherein the cassette is mounted in a track of the frame and the anchor block includes a head section, which is captured under flanges defining the track opening.

3. The sliding screen assembly of claim 2, wherein the fastening mechanism includes a clamp associated with an associated one of the wires, each clamp being arranged to slide along the cassette to provide for tension adjustment.

4. The sliding screen assembly of claim 3, wherein the anchor block includes a cross piece which is located adjacent the frame, the guide wires between the fastening mechanism and bar passing over the cross piece.

5. A cassette for use in a sliding screen assembly with a screen, a pull bar for movement between an open and a closed position, a series of guide wires which pass through the screen and pull bar to be attached to an adjacent frame of the assembly, the assembly including a cassette mounted to the frame for fastening ends of the guide wires, the cassette having an anchor block to secure the cassette in a track of the assembly and a fastening mechanism to adjustably secure the wires to the cassette, wherein the cassette includes an elongate body with the anchor block located towards one end and the fastening mechanism being adjustably positioned toward the other end.

6. A roller device for diverting a guide wire through a pull bar of a sliding screen assembly with a screen, a pull bar for movement between an open and a closed position, a series of guide wires which pass through the screen and pull bar to be attached to an adjacent frame of the assembly, the assembly including a cassette mounted to the frame for fastening ends of the guide wires, the cassette having an anchor block to secure the cassette in a track of the assembly and a fastening mechanism to adjustably secure the wires to the cassette, the roller device including a housing for carrying a roller wheel, the housing having a boss for locating the device in a slot of the bar, the boss having an enlarged section to lock the device in place and a passage to lead the guide wire through the boss and onto the roller wheel.

* * * * *